US005213078A

United States Patent [19]

Kolberg et al.

[11] Patent Number: 5,213,078

[45] Date of Patent: May 25, 1993

[54] METHOD FOR DETERMINING AT LEAST ONE END POSITION OF A DISPLACEMENT DEVICE IN A MOTOR VEHICLE

[75] Inventors: Gerhard Kolberg, Bühl-Weitenung; Karl-Heinrich Preis, Bühlertal; Jörg Holzberg, Renchen; Stefan Koch, Ottersweier, all of Fed. Rep. of Germany

[73] Assignee: Robert Bosch GmbH, Stuttgart

[21] Appl. No.: 761,989

[22] PCT Filed: Mar. 7, 1990

[86] PCT No.: PCT/DE90/00163

§ 371 Date: Sep. 25, 1991

§ 102(e) Date: Sep. 25, 1991

[87] PCT Pub. No.: WO90/11442

PCT Pub. Date: Oct. 4, 1990

[30] Foreign Application Priority Data

Mar. 25, 1989 [DE] Fed. Rep. of Germany ..... 3909905

[51] Int. Cl.[5] ..... F02D 41/28; F02D 11/10

[52] U.S. Cl. ..... 123/399; 73/118.1

[58] Field of Search ..... 123/339, 361, 399, 494; 73/116, 118.1

[56] References Cited

U.S. PATENT DOCUMENTS

| | | | |
|---|---|---|---|
| 4,359,894 | 11/1982 | Ikeura et al. | 73/118.2 |
| 4,506,642 | 3/1985 | Pfalzgraf et al. | 123/361 |
| 4,515,009 | 5/1985 | Hasegawa et al. | 123/478 X |
| 4,519,361 | 5/1985 | Murakami | 123/399 |
| 4,622,936 | 11/1986 | Junginger et al. | 123/399 |
| 4,722,313 | 2/1988 | Kohler et al. | 123/494 |
| 4,736,722 | 4/1988 | Ciampolini et al. | 123/339 |
| 4,951,206 | 8/1990 | Kyohzuka | 73/118.1 X |

*Primary Examiner*—Tony M. Argenbright
*Attorney, Agent, or Firm*—Walter Ottesen

[57] ABSTRACT

A method is presented for determining at least one end position of a displacement device (14) in a motor vehicle, wherein the displacement device (14) can be driven in the direction of its end positions and, in order to determine the particular end position, the displacement device (14) is driven to this end position and, on reaching this end position, the position of the displacement device is stored as representing the end position. Storage of the position of the displacement device of the particular end position takes place when the control variable of the displacement device has reached a particular predetermined value and/or has maintained this value for a predetermined period of time. This method is utilized in an advantageous manner to determine the end positions of a power actuator of an internal combustion engine of a motor vehicle.

9 Claims, 3 Drawing Sheets

METHOD FOR DETERMINING AT LEAST ONE END POSITION OF A DISPLACEMENT DEVICE IN A MOTOR VEHICLE

FIELD OF THE INVENTION

The invention relates to a method for determining at least one end position of a displacement device in a motor vehicle.

BACKGROUND OF THE INVENTION

Such a method for determining at least one end position of a displacement device in a motor vehicle is known from U.S. Pat. No. 4,506,642. A displacement device for controlling the engine power with two end positions is described there, wherein, in order to determine and store these two end positions of the displacement device, the displacement device is first driven in the direction of the first end position and, after a predetermined displacement time has elapsed, the position of the displacement device is stored as the end position. The displacement device is then driven in the direction of the second end position with the position of the displacement device being stored after a further predetermined time period has elapsed as the second end position. In this procedure, however, it is possible that, on the one hand, the recording of an incorrect end position can, for example, occur due to the flexibility of the stop and, on the other hand, due to mechanical or electrical tolerances or due to the flexibility of the stop mentioned above, an increase in the control variable of the displacement device, and thus destruction of or damage to the displacement device, can occur.

SUMMARY OF THE INVENTION

The invent is therefore based on the object of avoiding the above-mentioned disadvantages in a method of the type mentioned initially. U.S. Pat. No. 4,622,936 discloses an electronic accelerator pedal which, for the purpose of ascertaining the end positions of the throttle flap, approaches the particular end position in a controlled manner starting with a minimum or maximum desired value by increasing or reducing this desired value and detects from the manipulated variable a driving of the throttle flap toward the particular end position. The desired value then present is stored as a desired value representing the end position if the manipulated variable exceeds a predetermined value.

However, this procedure does not take into account the fact that an increase in the manipulated variable can also occur, for example, because of mechanical jamming of the throttle flap or because of friction. Furthermore, the end position is approached in a controlled manner and thus correspondingly slowly since the desire value can only be changed with a speed such that the throttle flap follows the change synchronously.

The procedure presented below eliminates the above-mentioned disadvantages of the prior art in that, when the device is driven to the particular end position, the control variable of the displacement device is interrogated and the position of the displacement device is stored as the particular end position when this control variable of the displacement device has taken on at least a particular predetermined value. This method can, in particular, be used advantageously in the determination of the end positions of an electrically controllable power actuator, in particular the throttle flap of an internal combustion engine or the injection pump of a diesel engine of a motor vehicle. By means of the features described it is possible that, on the one hand, in the case of flexible stops (such as are represented, for example, by the rubber buffers at the full-load stop of an injection pump mechanism), the displacement device is pressed into its correct position and, on the other hand, destruction of or damage to the displacement device due to a control signal which has passed beyond its permissible limits, is prevented. In this way, an accurate determination of the end positions of the displacement device is achieved and the life of the displacement device is increased.

The method according to the invention is not limited only to its use for determining end positions of the power actuator of an internal combustion engine but can be utilized wherever controllable displacement devices, whose end positions have to be determined for further information, are present.

Further advantages are given by the dependent claims in association with the following description of an embodiment.

BRIEF DESCRIPTION OF THE DRAWINGS

The invention is explained below with the aid of the embodiments shown in the drawing.

DESCRIPTION OF THE PREFERRED EMBODIMENTS OF THE INVENTION

Although the following embodiment describes only the application of the method according to the invention to displacement devices for a throttle flap, the term displacement device is also understood below to mean the electrically actuable injection pump mechanism, the method according to the invention having particular importance in that case because of the flexible position motor stops.

Figure 1:
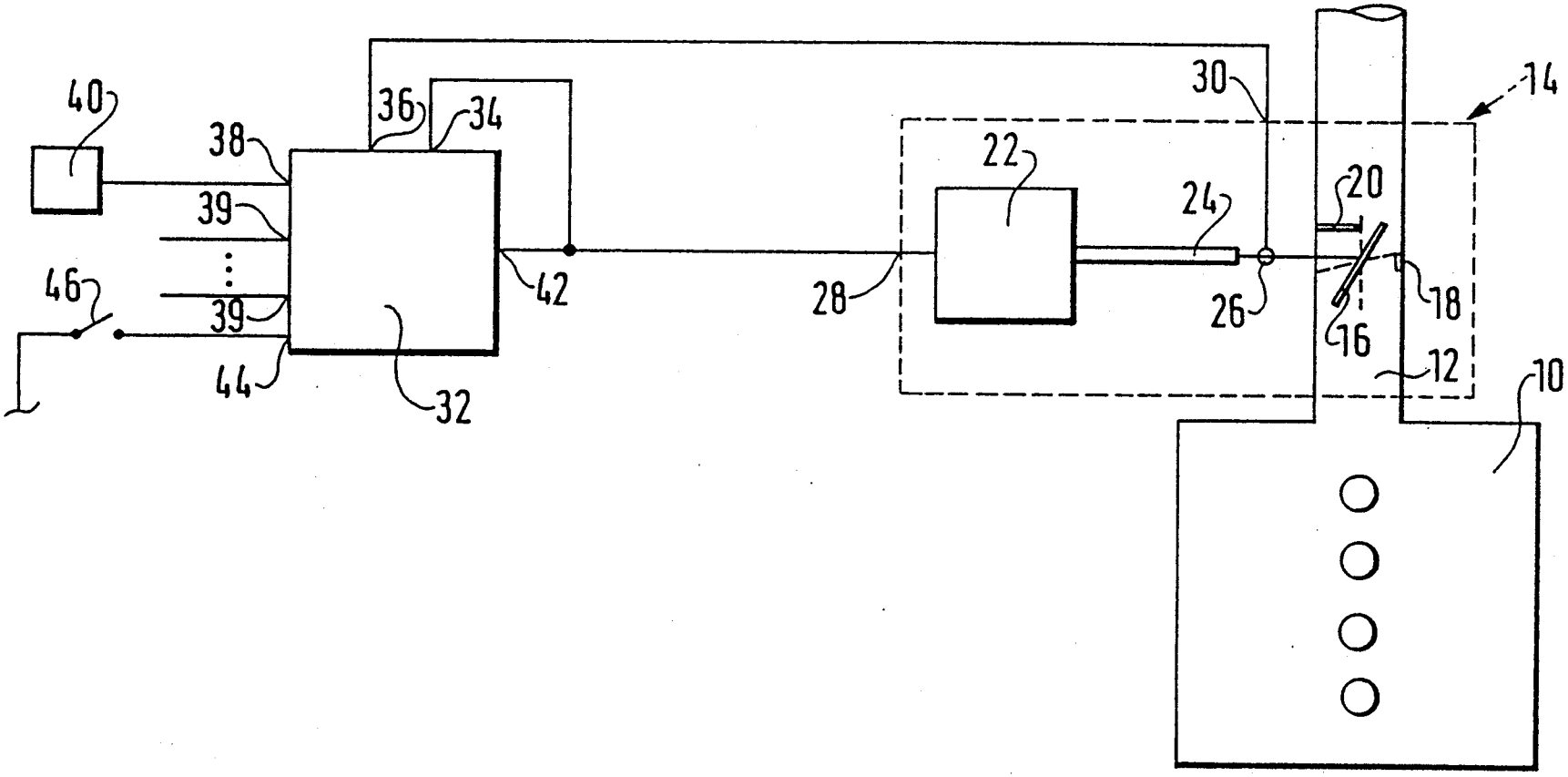
FIG. 1 shows a block diagram (selected for reasons of clarity) of an embodiment in which the method shown in FIGS. 2 to 4 using flow diagrams can be employed.

FIG. 1 shows an internal combustion engine 10 with an intake pipe 12 and a displacement device 14 which can be actuated electrically. This displacement device 14 includes a throttle flap 16 located in the intake pipe 12. The throttle flap 16 has a symbolically represented lower end position 18 and a similarly symbolically represented upper end position 20. The lower end position 18 corresponds to the idle position of the throttle flap while the upper end position 20 corresponds to the full-load position of the throttle flap. In addition, the displacement device 14 includes a position motor 22 which can be electrically actuated and which is connected via a connecting piece 24 to the throttle flap 16 in such a way that it changes the position of the throttle flap as a function of a control variable. Furthermore, the displacement device 14 consists of a position sensor 26 by means of which the position of the position motor 22 and/or the throttle flap 16 can be detected.

The displacement device 14 has essentially an input 28 and an output line 30. The control variable formed by a control unit 32 as a function of characteristic operating variables is supplied to the displacement device 14 via its input 28. The output line 30 feeds back to the control unit 32 a signal corresponding to the actual position of the displacement device and formed by the position sensor 26. The control unit 32 is supplied with the control variable via its input 34, with the position signal of the displacement device 14 via the input 36, with the position of an accelerator pedal 40 via the input 38, with other characteristic operating variables, such as engine temperature, rotational speed, travelling speed and/or gear selected, (as a function of which the control variable which is emitted by the control unit via its output 42 to the displacement device 14 is formed) via the inputs 39 and with a starting signal via the input 44, which is connected to an ignition switch 46.

With respect to the mode of operation of the device shown in FIG. 1, it may be stated that when the ignition switch 46 is closed, the control unit 32 receives, via its input 44, a starting signal which initializes the circuit elements of the control unit and starts the method according to the invention. The control unit 32 forms a control variable in dependence upon characteristic operating variables supplied via its inputs 39 and in dependence upon the accelerator pedal position, which is entered from the accelerator pedal 40 via the input 38. This control variable, via the output 42, determines the direction of movement or the position of the displacement device 14 and therefore controls the power actuator, which is the throttle flap in the case of the embodiment.

Depending on the configuration of the displacement device 14 or of the position motor 22, the control variable described above is the motor current with the direction of movement of the displacement device 14 being determined by the direction of the current, or is a control variable taken from the drive voltage or, from a pulse duty factor, in the case of an appropriately configured position motor. It is also possible to use a mean value of this control variable as a feedback control variable.

Corresponding statements apply in the case of the injection pump mechanism (control rod) of a diesel engine.

Figure 2:
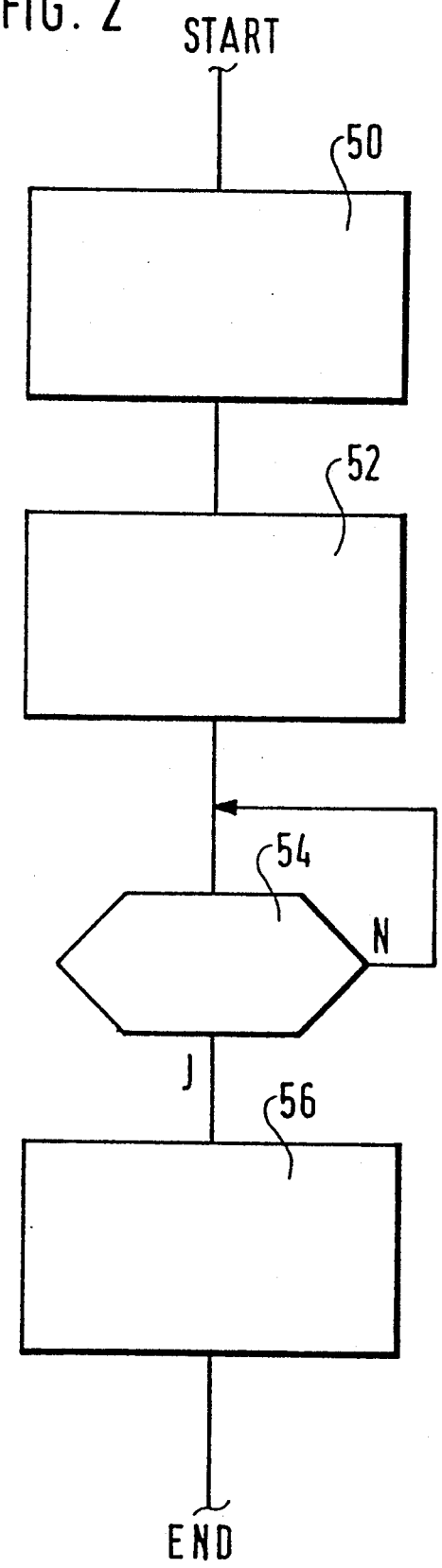

FIG. 2 shows a flow diagram which illustrates the method of the invention. When the ignition switch is closed, that is at the beginning of an operating cycle, the method is started. All the measures which are used for initialization and for charging the electronic switching elements of the control unit 32 are summarized in function block 50. When this procedure has been concluded, the device is driven to the lower stop of the power actuator in function block 52 and, after storage of the value of the position to which the actuator has been driven, the position is determined by the method according to the invention. After processing of the function block 52 and after the motor vehicle has taken up normal driving operation, it is determined in the interrogation block 54 whether the power actuator is located in the vicinity of its full-load position. This interrogation is repeated until, during driving operation corresponding to the wishes of the driver, the power actuator has approximately taken up its full-load position. The device is then driven to this full-load position in function block 56 and, after storage of the value, the position of the displacement device 14 is determined by the method according to the invention. It is also possible to omit the storage of this value and to determine the position exclusively in accordance with the method according to the invention.

The embodiments of the method according to the invention which are presented in FIGS. 3 and 4 below can each be used on their own, independently of their inclusion in FIG. 2.

Figure 3:
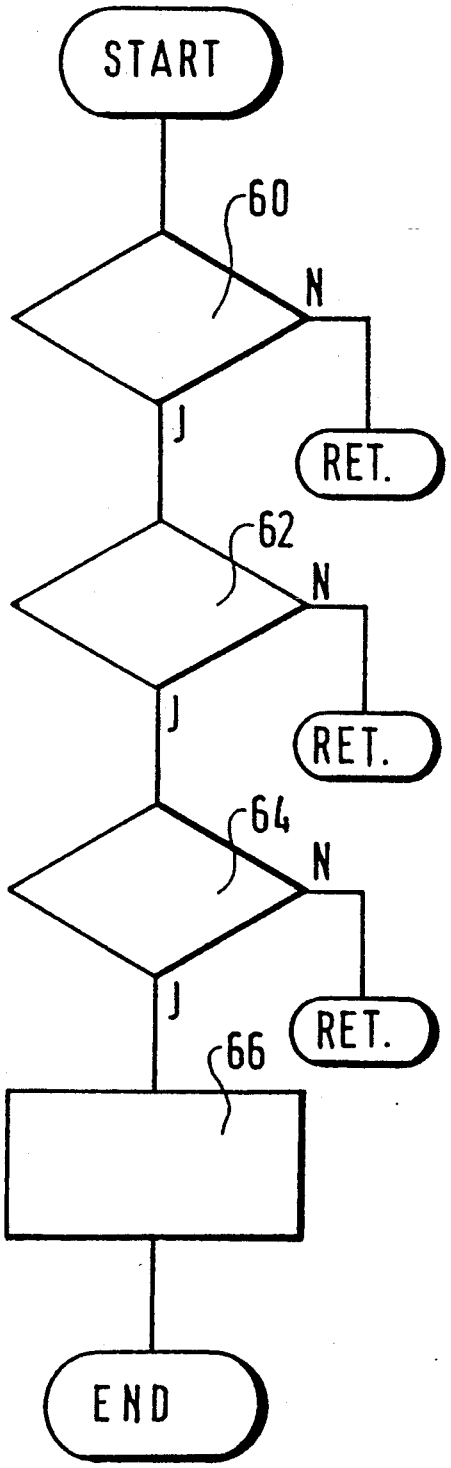

The method according to the invention is shown in FIG. 3 using the example of the lower stop of a throttle flap which can be actuated electrically. After the control unit has been initialized and after the device has been driven to the stop, the control variable is monitored and compared to a specified threshold value which is derived from a permissible limit value of the control variable. If the motor current is used as the control variable, this limit value is provided by the maximum permissible current. Similar limit values can also be formed for the other possible control variables obtained from voltage or pulse duty factor. In the function block 60 of FIG. 3, a check is made as to whether the particular control variable has reached the predetermined threshold value and has maintained this threshold value for a predetermined time period. If this is not the case, the interrogation is repeated. If, however, the control variable has taken on the predetermined value and has held this value for a predetermined time, then a check is made in function block 62 as to whether the displacement device 14 is located in the region of its lower end position.

The above is intended to prevent storage of the position of the displacement device 14 as the end position of the power actuator for taking place if the control variable reaches the predetermined threshold value because of the power actuator becoming jammed. Such an interrogation can, on the one hand, be carried out by means of a comparison of the measured position of the displacement device with a threshold value and, on the other hand, by a comparison between a stop switch (that is, idle or full-load switch of the throttle flap) and the position of the displacement device 14. In function block 64, a check is made as to whether the displacement device 14 is, at this instant, driven against the lower end position. If the motor current is designated as the control variable, this interrogation can take place by means of the direction of the current. If all the interrogation conditions of the function blocks 60 to 64 have been satisfied, the actual position of the displacement device 14 is stored as the lower end position in the step of the function block 66. If, however, one of the interrogation conditions has not been satisfied, the steps represented in FIG. 3 can be repeated. The method shown in FIG. 3 can take place subsequent to the previous operation, known from the prior art, of driving to the lower end position and storage of the corresponding position value.

Figure 4:
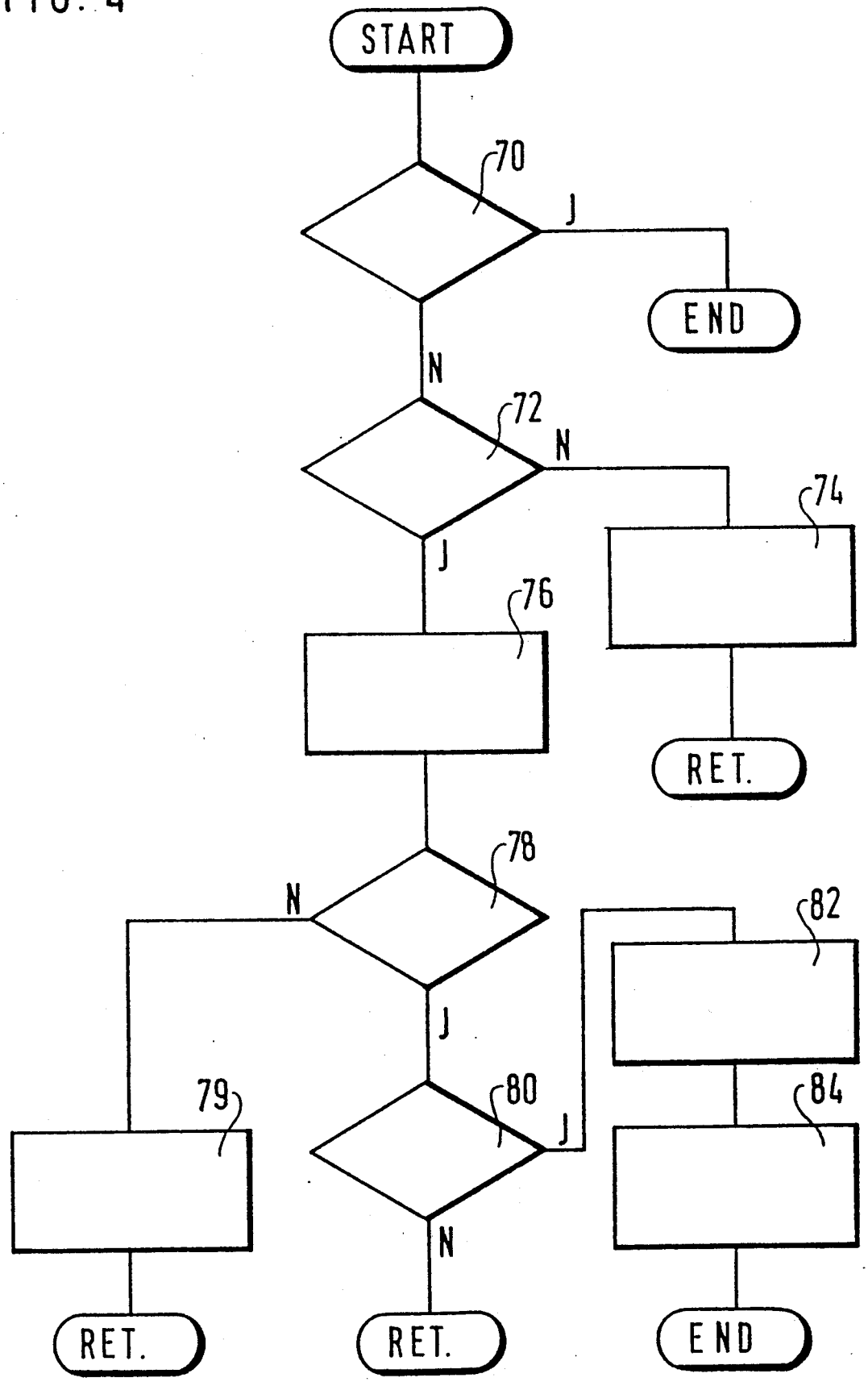

A further embodiment of the method according to the invention is shown in FIG. 4 using, as an example, the upper stop of the power actuator of an internal combustion engine, in particular a throttle flap or injection pump. After the determination of the lower stop has been concluded, the device is driven to the upper stop during the driving operation or else directly after the determination of the lower stop before the beginning of the operating cycle and this upper stop can be determined according to the method shown in FIG. 4. The first time the device is driven to the upper stop, the operation occurs with a high torque in order to ensure that the upper stop is reached. If this upper stop consists of a flexible material, if for example it is a rubber buffer, the adopted position value when first driving to it is too large. On reaching the full-load position of the throttle, flap, a check is made in function block 70 of FIG. 4 as to whether a pass has already taken place during the operating cycle. If this is not the case, it is determined in function block 72 whether the upper stop has already been driven to for the first time. If not, this is carried out in step 74. If this has already taken place, the control variable is limited in the function block 76 to a predetermined value, which is derived from the permissible limit value less the tolerance values. By this means, the displacement device 14 is brought into a defined position, particularly when the stop consists of a flexible material which resets the displacement device. Flexible material can also be understood to mean the usual return spring. In interrogation block 78, it is determined whether the position of the displacement device 14 is located in the vicinity of the upper stop, that is whether the position of the displacement device 14 exceeds a certain limit value or that, in the case of a activated full-load switch, the position of the displacement device 14 has reached a certain limit value. If this is not the case, the limitation of the control variable is withdrawn and the steps presented above are repeated (function block 79). If the position of the displacement device 14 is in the region of the end position, a check is made in function block 80 as to whether a specified time has elapsed.

This acts to produce stable conditions. If the time has elapsed, the actual position of the displacement device 14 is stored in function block 82 as the upper end position of the displacement device 14 and the limitation of the control variable is cancelled. In addition, a flag is set in function block 84 that the end position has been determined in this operating cycle. If the second possibility, not presented in the above description, should occur in the interrogation blocks 70, 72 and 80, then the steps are repeated.

The above description of the embodiments of the methods according to the invention is based on only one use of the methods per operating cycle.

The methods according to the invention can, of course, also be carried out, if desired, several times during an operating cycle, for example to compensate for a temperature drift.

We claim:

1. A method for determining at least one end position of a displacing device in a motor vehicle, the method comprising the steps of:

forming a desired value from at least one operating characteristic variable;

closed-loop controlling the position of said displacing device in dependence upon said desired value by means of a control unit which supplies a control variable to said displacing device;

determining an end position of said displacing device for predetermined operating conditions by open-loop controlling said displacing device in the direction of a particular end position independently of said desired value; and, storing the position of said displacing device as the particular end position when said control variable for said displacing device at least assumes a pre-given value for a predetermined time duration and said displacing device is disposed in the region of said particular end position.

2. The method of claim 1, wherein the position of the displacing device is stored when a determination of this end position has previously taken place.

3. The method of claim 1, wherein the position of the displacing device is stored when the control variable exceeds a predetermined value.

4. The method of claim 1, wherein the position of the displacing device is stored when the control variable has reached a predetermined limit value.

5. The method of claim 1, wherein the displacing device, is configured with an electronic control unit such that it can be driven between the end positions.

6. The method of claim 5, wherein said displacing device is an electrically actuable power actuator of an internal combustion engine of a motor vehicle.

7. The method of claim 1 wherein a drive current is used as the control variable and, in the case of a positive change of the drive current, the displacing device is directed into one end position and in the case of a negative change of the drive current, the displacing device is directed into the other end position.

8. The method of claim 1, wherein the control variable is provided by means of one of: a drive voltage, a drive pulse duty factor i the case of a clock pulse driven displacing device, a frequency signal, and a mean value signal of one of a current, voltage, pulse duty factor and frequency.

9. The method of claim 1, wherein the region of the particular end position is determined by comparing the position of the displacing device with at least one of a predetermined threshold value alone and by actuating a stop switch in association with a comparison between the position of the displacing device and a predetermined threshold value.

* * * * *

UNITED STATES PATENT AND TRADEMARK OFFICE

CERTIFICATE OF CORRECTION

PATENT NO. : 5,213,078

DATED : May 25, 1993

INVENTOR(S) : Gerhard Kolberg, Karl-Heinrich Preis, Jörg Holzberg and Stefan Koch It is certified that error appears in the above-identified patent and that said Letters Patent is hereby corrected as shown below:

In column 1, line 54: delete "desire" and substitute -- desired -- therefor.

In column 3, line 4: between "selected," and "(as", insert -- etcetera --.

In column 4, line 62: after "throttle", delete -- , --.

In column 6, line 27: between "claim 1" and "wherein", insert -- , --.

In column 6, line 35: delete "i" and substitute -- in -- therefor.

Signed and Sealed this

Fourth Day of January, 1994

Bruce Lehman

*Attest:*

BRUCE LEHMAN

*Attesting Officer*

*Commissioner of Patents and Trademarks*